US007442071B2

(12) United States Patent
Bigotto

(10) Patent No.: US 7,442,071 B2
(45) Date of Patent: Oct. 28, 2008

(54) CLAMP FOR GRIPPING CABLES ISSUING FROM AN ELECTRIC CONNECTOR, AND ELECTRIC CONNECTOR FEATURING SUCH A CLAMP

(75) Inventor: Pier Carlo Bigotto, Cascine Vica Rivoli (IT)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/577,515

(22) PCT Filed: Oct. 28, 2004

(86) PCT No.: PCT/EP2004/052695

§ 371 (c)(1),
(2), (4) Date: Jun. 29, 2007

(87) PCT Pub. No.: WO2005/043690

PCT Pub. Date: May 12, 2005

(65) Prior Publication Data

US 2007/0281539 A1 Dec. 6, 2007

(30) Foreign Application Priority Data

Oct. 31, 2003 (IT) ..... TO2003A0858

(51) Int. Cl.
*H01R 13/58* (2006.01)

(52) U.S. Cl. ..... 439/470

(58) Field of Classification Search ..... 439/459, 439/467, 465, 470, 462
See application file for complete search history.

(56) References Cited

U.S. PATENT DOCUMENTS 5,934,931 A * 8/1999 Castaldo ..... 439/467
5,961,351 A 10/1999 Wu ..... 439/610
6,111,201 A * 8/2000 Drane et al. ..... 174/92
6,126,478 A * 10/2000 Presson et al. ..... 439/467

FOREIGN PATENT DOCUMENTS

DE 31 08 744 A1 9/1982

* cited by examiner

*Primary Examiner*—Alexander Gilman
(74) *Attorney, Agent, or Firm*—Harrington & Smith, PC

(57) ABSTRACT

A clamp (1), for gripping cables (2) issuing from an electric connector (3), is fitted to the insulating casing (4) of the connector (3), and has two jaws (21, 22), which are joined by a virtual hinge (23) to rotate between an open position and a closed position, and are kept in the closed position by a retaining device (49) formed in one piece with the jaws (21, 22); the clamp (1) also has an elastic parting device (30) interposed between the jaws (21, 22), spaced apart from the virtual hinge (23), and exerting elastic thrust on the jaws (21, 22) to push the jaws into the open position.

23 Claims, 3 Drawing Sheets

CLAMP FOR GRIPPING CABLES ISSUING FROM AN ELECTRIC CONNECTOR, AND ELECTRIC CONNECTOR FEATURING SUCH A CLAMP

TECHNICAL FIELD

The present invention relates to a clamp for gripping cables issuing from an electric connector, particularly of the type used in automotive applications.

BACKGROUND ART

As is known, in the automotive industry, electric connecting units are used comprising two complementary connectors fitted to each other in a given direction. Each connector normally comprises an insulating casing, which defines a number of cavities having axes parallel to the coupling direction of the connector to the complementary connector, and housing, in use, respective electric terminals connected electrically to the terminals of the complementary connector.

The terminals are retained inside the respective cavities by elastic retaining lances, and are connected to respective electric cables issuing from the insulating casing through an end wall.

In many known solutions, a portion of the cables outside the insulating casing is gripped between two jaws to hold the cables in place and prevent in-service vibration, any inaccuracy or excessive pull during assembly, and/or excessive pull on the cables after assembly, from impairing electric contact of the terminals and, therefore, signal transmission and/or power supply of the vehicle. To keep the jaws clamped firmly, a slide body is provided, which slides over and forces the jaws onto the cables, e.g. by means of a cam or ramp coupling.

Known solutions of the above type are unsatisfactory, on account of the type of jaws used and the slide body creating fairly considerable bulk adjacent to the end wall of the insulating casing, and the tightening time involved, mainly to slide and force the slide body onto the jaws.

Moreover, using known solutions of the above type, fitters, when assembling the connector and electric system to the vehicle, are not always able to determine proper fit of the slide body, or correct grip of the cables by the jaws, on account of the jaws and the cable portions to be gripped being concealed by the slide body.

DISCLOSURE OF INVENTION

It is an object of the present invention to provide a clamp for gripping cables issuing from an electric connector, and designed to provide a straightforward, low-cost solution to the above problems.

According to the present invention, there is provided a clamp for gripping cables issuing from an electric connector; the clamp comprising two jaws movable with respect to each other between a parted open position and a closed position gripping said cables; and fastening means for fitting the clamp to an insulating casing of said electric connector; retaining means being provided to keep said jaws in said closed position; characterized in that said retaining means are formed in one piece with said jaws.

The present invention also relates to an electric connector.

According to the present invention, there is provided an electric connector as claimed in claim 15.

BRIEF DESCRIPTION OF THE DRAWINGS

A non-limiting embodiment of the invention will be described by way of example with reference to the accompanying drawings, in which.

BEST MODE FOR CARRYING OUT THE INVENTION

Number 1 in the accompanying drawings indicates a clamp for gripping cables 2 issuing from an electric connector 3 (shown partly).

Figure 5:
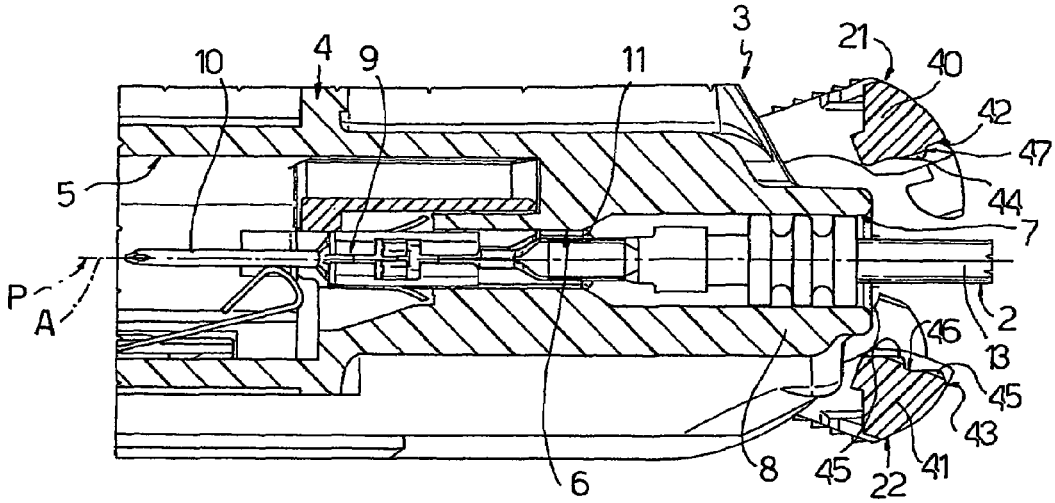
FIG. 5 shows a cross section, with parts removed for clarity, of the FIG. 4 electric connector.

With reference to FIG. 5, connector 3 comprises an insulating casing 4 defining a front cavity 5 engaged, in use, by a complementary connector (not shown), and a number of parallel, side by side channels 6 (only one shown), which communicate with cavity 5, have respective axes A parallel to a longitudinal coupling direction of connector 3 to the complementary connector, and come out through respective openings 7 formed in a rear portion 8 of casing 4.

Channels 6 house respective known male electric terminals 9 connected in fixed positions to casing 4, in known manner not described in detail, and each of which comprises a blade-type end contact portion 10 projecting inside cavity 5, and a connecting portion 11 for connection to a respective electric cable 2.

Cables 2 extend from portion 8, in a direction parallel to respective terminals 9, through openings 7, and comprise respective portions 13 outside casing 4 and which are gripped by clamp 1.

Figure 3:
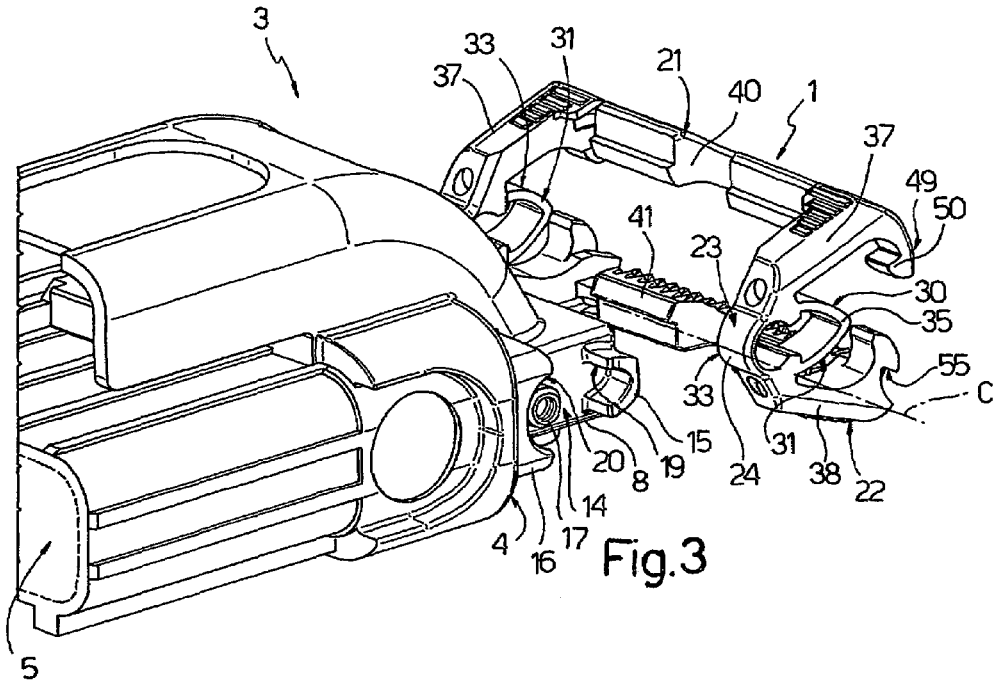
FIGS. 3 and 4 show, in perspective, assembly of the clamp according to the present invention to the insulating casing of an electric connector.
Figure 4:
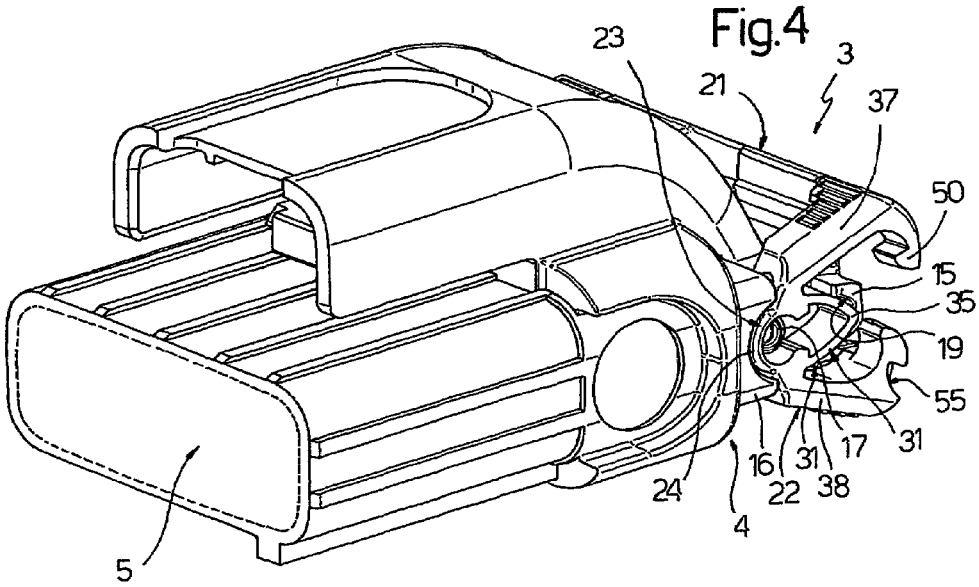

With reference to FIG. 3, portion 8 comprises two parallel lateral faces 14 (only one shown), from each of which project integrally a pair of appendixes 15, 16, and a cylindrical pin 17 interposed between appendixes 15, 16 along a plane P (FIGS. 5 and 6) containing axes A of channels 6 and openings 7. The two pins 17 are coaxial along an axis lying in plane P; appendixes 15 are located on the end edge of portion 8, are symmetrical in shape with respect to plane P, and define respective V-shaped seats 19 facing pins 17; and appendixes 16 define respective concave surfaces 20 facing and coaxial with pins 17.

With reference to the accompanying drawings, pins 17 define a hinge, about which clamp 1 is mounted to rotate. More specifically, clamp 1 is formed in one piece, preferably from plastic material, and comprises two jaws 21, 22 joined by a virtual hinge 23, which is defined by two arc-shaped portions 24 spaced apart and coaxial with each other along an axis C parallel to the axis of pins 17. Portions 24 are housed between pins 17 and surfaces 20, define respective substantially circular seats 26 engaged radially loosely by pins 17, have ends 27 defining respective intermediate openings 28 between jaws 21, 22, and are deformable elastically to enable jaws 21, 22 to rotate, with respect to each other and about axis C, between a parted open position (FIG. 6), and a closed position (FIG. 7) gripping portions 13 of cables 2.

Clamp 1 also comprises an elastic parting device 30, which is interposed between jaws 21, 22, is spaced apart from hinge 23 in a direction perpendicular to axis C, and exerts elastic thrust on jaws 21, 22 to push the jaws into the open position. Device 30 comprises two elastically deformable portions 31, which are aligned and spaced apart in a direction parallel to axis C, are integral with portions 24, and extend from ends 27 and face openings 28 to define, together with portions 24, two elastically deformable rings 33 shaped symmetrically with respect to a mid-plane of clamp 1 containing axis C.

Portions 31 are ogival in shape, and comprise respective pairs of arc-shaped, outwardly-convex branches or blades 34 joined at respective tips 35, which face away from hinge 23 and at least partly engage seats 19 to keep clamp 1 in an angularly fixed reference position in which jaws 21, 22 are positioned symmetrically with respect to plane P.

Figure 1:
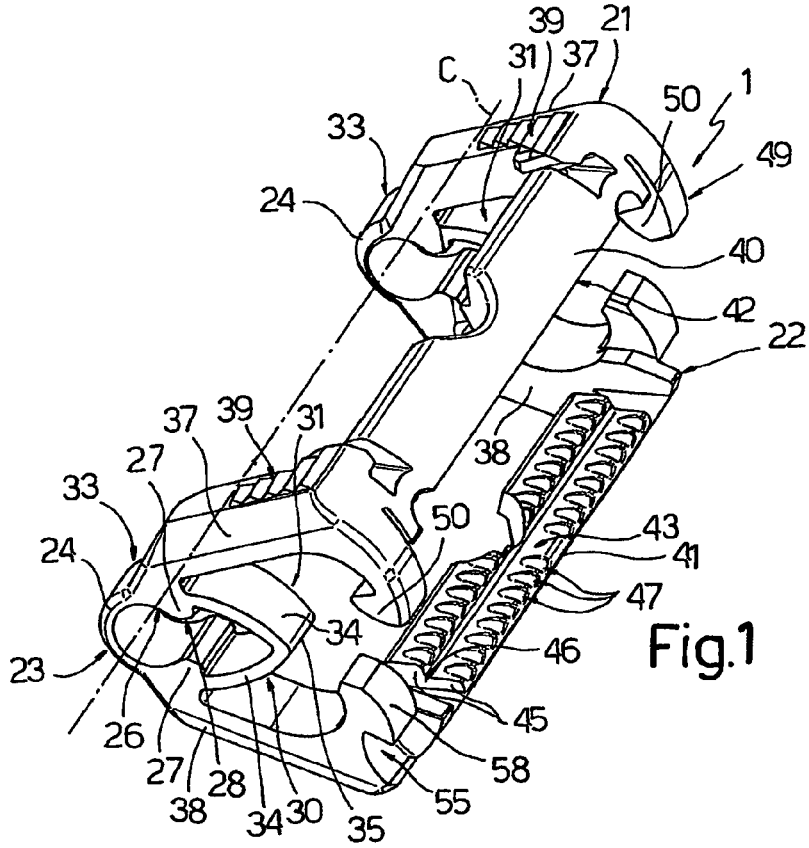
FIGS. 1 and 2 show two different views in perspective of a preferred embodiment of a clamp for gripping cables issuing from an electric connector, in accordance with the present invention.
Figure 2:
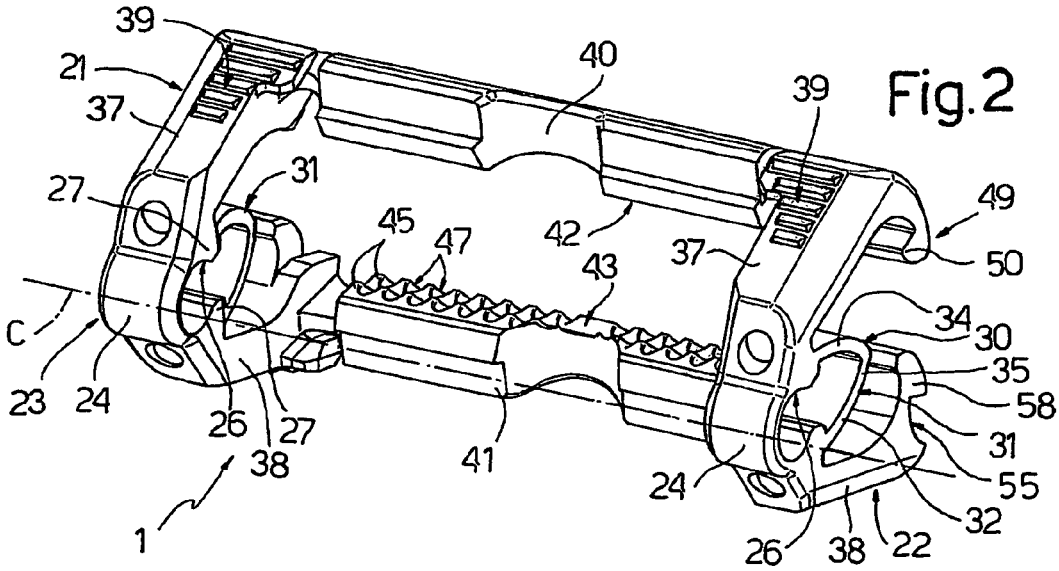

With reference to FIGS. 1, 2 and 5, jaws 21, 22 are U-shaped, and each comprise two lateral arms 37, 38 integral with rings 33. The arms of each jaw 21, 22 project from ends 27, are parallel to each other, and have respective backs 39, which are at least partly knurled or ribbed for easy manual pressure by fitters.

Jaws 21, 22 also comprise respective intermediate portions 40, 41, which extend between the ends of arms 37, 38 in a direction parallel to axis C, i.e. in a direction perpendicular to cables 2, and have respective facing surfaces 42, 43 for gripping portions 13. Surface 42 has a triangular-section tooth 44 parallel to axis C, while surface 43 has two teeth 45 parallel to axis C and defining, in between, a recess 46 complementary to tooth 44 and engaged by tooth 44 when jaws 21, 22 are in the closed position. Teeth 44, 45 have a number of grooves 47 perpendicular to axis C, and which provide for positioning and retaining cables 2 in a direction parallel to axis C.

Figure 6:
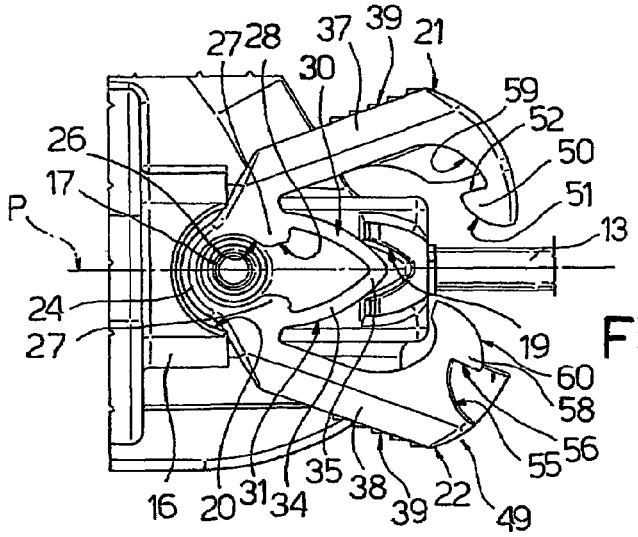
FIGS. 6 and 7 show partial side views of the FIG. 5 electric connector, and the clamp in an open and closed position respectively.
Figure 7:
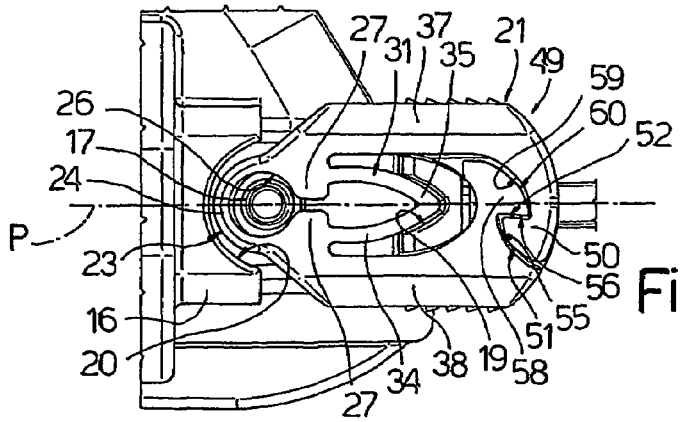

With reference to FIGS. 6 and 7, a conveniently click-on retaining device 49 is provided to keep jaws 21, 22 in the closed position, and comprises two hooks 50, which are integral with jaw 21, define extensions of arms 37 at opposite ends of portion 40, face tips 35, and are defined by respective convex surfaces 51 facing arms 38, and by respective flat retaining surfaces 52 facing and substantially parallel to arms 37.

Device 49 also comprises two seats 55, which are formed in jaw 22, at opposite ends of portion 41, are complementary to hooks 50, and have respective flat retaining surfaces 56 which rest on respective surfaces 52 in the closed position. Surface 56 of each seat 55 is defined by a tooth 58, which engages the gap 59 between relative surface 52 and relative arm 37 in the closed position (FIG. 7), and has a curved, convex surface 60 which slides against surface 51 of relative hook 50 when closing jaws 21, 22.

To fit clamp 1 to casing 4 (FIG. 3), rings 33 are parted slightly along axis C, making use of the flexibility of the material from which clamp 1 is made; clamp 1 is fitted longitudinally onto portion 8; seats 26 are positioned along pins 17; and arms 37, 38 are released to insert portions 24 between pins 17 and surfaces 20, and to insert tips 35 inside seats 19.

To grip cables 2 (FIG. 7), jaws 21, 22 are brought together, by pressing manually on backs 39 in opposition to the elastic parting force of rings 33, to slide surfaces 60 along surfaces 51 and click hooks 50 inside seats 55, and teeth 58 inside gaps 59.

In the event device 49 does not lock properly, portions 31 spring open jaws 21, 22, thus giving the fitter both a visual and tactile indication of an improper clamping condition.

As will be clear from the foregoing description, the bulk produced by clamp 1 close to portion 8 of casing 4 is relatively small, on account of device 49 being formed in one piece with jaws 21, 22, and no additional retaining body being required to keep jaws 21, 22 in the closed position.

Cables 2 are also clamped extremely quickly, by virtue of there being no additional retaining bodies to handle, and jaws 21, 22 being clicked together by simply pressing on arms 37, 38.

Correct closure of jaws 21, 22 and grip of cables 2 are relatively easy to determine, by virtue of device 49 and portions 40, 41 not being concealed by other parts of connector 3, and by virtue of device 30 springing jaws 21, 22 open in the event of improper grip.

Clamp 1 is also relatively straightforward, in that hinge 23 and device 30 also provide, respectively, for fitting jaws 21, 22 to casing 4 and keeping clamp 1 in a fixed reference position with respect to casing 4.

Moreover, the design of surfaces 42, 43 provides for firm grip and stable positioning of cables 2 once jaws 21, 22 are closed.

Clearly, changes may be made to clamp 1 as described herein without, however, departing from the scope of the present invention.

In particular, as opposed to two spaced hooks 50, one locking or retaining member may be provided, possibly located in a different position from those shown by way of example.

Alternatively, if intermediate portions 40, 41 of jaws 21, 22 are exceptionally long, a further locking or retaining device may be provided in addition to and interposed between the two end hooks 50.

Clamp 1 may be connected to casing 4 otherwise than as shown, e.g. by means of teeth engaging respective seats in casing 4, and/or at least one of jaws 21, 22 may be formed in one piece with casing 4.

Jaws 21, 22 may be connected to each other by other than hinge 23, but still in such a manner as to rotate or translate between the open and closed positions, and/or axis C may be parallel as opposed to crosswise to cables 2.

Finally, device 30 may comprise elastically deformable portions differing from portions 31, and/or elastic members separate from jaws 21, 22.

The invention claimed is:

1. A clamp for gripping cables issuing from an electric connector; the clamp comprising two jaws movable with respect to each other between a parted open position and a closed position gripping said cables; and fastening means separably for fitting the clamp to an insulating casing of said electric connector; retaining means being provided on said jaws which engage each other to keep said jaws in said closed position; characterized in that said retaining means are formed in one piece with said jaws, wherein the clamp is formed from plastic material and is sized and shaped to be directly connected via said fastening means to said insulating casing of the electric connector.

2. An electric connector comprising:

an insulating casing, a number of cables issuing from said insulating casing, and a clamp for gripping said cables and fitted to said insulating casing;

characterized in that said clamp is as claimed in claim 1.

3. An electric connector as claimed in claim 2, characterized by comprising hinge means for fitting said clamp to said insulating casing in rotary manner.

4. An electric connector as claimed in claim 3, characterized in that said insulating casing comprises reference means engaged at least partly by a portion of said clamp, to keep the clamp in a fixed angular position with respect to said insulating casing.

5. An electric connector as claimed in claim 4, characterized in that said clamp comprises elastic parting means interposed between said jaws and exerting elastic thrust on said jaws to push the jaws into said open position; said reference means comprising at least one reference seat engaged by said elastic parting means.

6. A claim as in claim 1 wherein said fastening means comprise a living hinge connecting said jaws to each other, wherein said living hinge is sized and shaped to be mounted on a portion of said insulating casing.

7. A clamp for gripping cables issuing from an electric connector, the clamp comprising:

two jaws movable with respect to each other between a parted open position and a closed position for gripping the cables;

a fastening section which is sized and shaped to directly attach the clamp to an insulating casing of the electric connector; and retainers on the jaws which are sized and shaped to engage each other to fix the jaws in the closed position, wherein the clamp is a one-piece member formed from plastic material.

8. A clamp as in claim 7 wherein the fastening section comprises a living hinge connecting the jaws to each other, wherein the hinge is sized and shaped to be received in a slot of the insulating casing.

9. A clamp as in claim 7 further comprising a spring section between the jaws and biasing the jaws towards the open position.

10. A clamp as in claim 9 wherein the spring section comprises a general V shaped section with ends connected to the jaws proximate the fastening section.

11. A clamp for gripping cables issuing from an electric connector; the clamp comprising:

two jaws movable with respect to each other between a parted open position and a closed position gripping said cables; and fastening means for fitting the clamp to an insulating casing of said electric connector;

retaining means being provided to keep said jaws in said closed position, characterized in that said retaining means are formed in one piece with said jaws;

a hinge enabling said jaws to rotate between said open position and said closed position about a hinge axis (C); and elastic parting means interposed between said jaws, spaced apart from said hinge, and exerting elastic thrust on said jaws to push the jaws into said open position.

12. A clamp as claimed in claim 11, characterized in that said hinge comprises elastically deformable portions forming part of said fastening means.

13. A clamp as claimed in claim 11, characterized in that said elastic parting means are formed in one piece with said jaws.

14. A clamp as claimed in claim 13, characterized in that said elastic parting means and said hinge together define two elastically deformable rings coaxial with each other and spaced apart along said hinge axis (C); said jaws projecting from said rings.

15. A clamp as claimed in claim 14, characterized in that each said ring is symmetrical with respect to a mid-plane of the clamp containing said hinge axis (C).

16. A clamp as claimed in claim 15, characterized in that said hinge comprises, in each said ring, a relative arc-shaped portion defining a circular seat having an opening formed in an intermediate position between said jaws.

17. A clamp as claimed in claim 15, characterized in that said elastic parting means comprise, for each said ring, a relative pair of arc-shaped branches joined at a tip.

18. A clamp as claimed in claim 17, characterized in that said tip faces away from said hinge.

19. A clamp for gripping cables issuing from an electric connector; the clamp comprising:

two jaws movable with respect to each other between a parted open position and a closed position gripping said cables;

fastening means for fitting the clamp to an insulating casing of said electric connector;

retaining means being provided to keep said jaws in said closed position, characterized in that said retaining means are formed in one piece with said jaws, and characterized in that said retaining means comprise a click-on connecting device.

20. A clamp as claimed in claim 19, characterized in that said retaining means comprise at least one hook integral with one of said jaws, and at least one corresponding retaining seat formed in the other of said jaws and engaged by said hook in said closed position.

21. A clamp as claimed in claim 20, characterized in that said jaws comprise respective pairs of lateral arms, and respective intermediate portions facing each other, parallel to said hinge axis (C), and for gripping said cables; said retaining means comprising two said hooks located on one of said jaws, at opposite ends of the relative intermediate portion, and two corresponding retaining seats formed in the other of said jaws, at opposite ends of the relative intermediate portion.

22. A clamp as claimed in claim 21, characterized in that at least one of said intermediate portions has a number of grooves perpendicular to said hinge axis (C).

23. A clamp as claimed in claim 21, characterized in that at least one of said intermediate portions comprises a tooth parallel to said hinge axis (C), and the other of said intermediate portions comprises an elongated recess engaged by said tooth in said closed position.

* * * * *